US005765095A

United States Patent [19]

Flak et al.

[11] Patent Number: 5,765,095

[45] Date of Patent: Jun. 9, 1998

[54] POLYCRYSTALLINE DIAMOND BIT MANUFACTURING

[75] Inventors: Richard A. Flak, Porter; T. H. (Nick) Nichols, Houston; Thomas W. Oldham, The Woodlands, all of Tex.

[73] Assignee: Smith International, Inc., Houston, Tex.

[21] Appl. No.: 699,387

[22] Filed: Aug. 19, 1996

[51] Int. Cl.[6] ..... B22F 7/08

[52] U.S. Cl. ..... 419/8; 419/18; 419/38; 419/42; 419/65; 419/68

[58] Field of Search ..... 419/8, 18, 38, 419/42, 65, 68; 175/428

[56] References Cited

U.S. PATENT DOCUMENTS 4,554,130 11/1985 Ecer ..... 419/8
4,919,013 4/1990 Smith et al. ..... 76/108.2
5,000,273 3/1991 Horton et al. ..... 175/329
5,032,352 7/1991 Meeks et al. ..... 419/8

*Primary Examiner*—Ngoclan Mai
*Attorney, Agent, or Firm*—Christie, Parker & Hale, LLP

[57] ABSTRACT

A method for manufacturing a PCD bit by isostatically or mechanically press forming a green on a metallic blank. A metallic blank is vertically suspended into a flexible vessel. Powder metal is mixed with a binder and introduced into the flexible vessel surrounding the lower end of the suspended metallic blank. The vessel is then isostatically or mechanically pressed causing the powder mixture to stick together and to the blank, forming a green on the blank. The blank and green are removed from the vessel and the exposed end of the metallic blank is chucked onto a milling machine and turned for milling the green into the shape of a PCD bit head. After the milling is completed, the green and blank are sintered, hardening the bit head shaped green and strongly bonding it to the metallic blank, forming a PCD bit wherein the hardened green is the bit head while the metallic blank is the bit pin.

39 Claims, 2 Drawing Sheets

POLYCRYSTALLINE DIAMOND BIT MANUFACTURING

BACKGROUND OF THE INVENTION

This invention relates to a method for forming a green state polycrystalline diamond (PCD) bit by milling a green state block of material bonded to a metallic blank. Once formed, the green state PCD bit can be sintered to its final hardened state.

Current methods of forming PCD bits require molds and/or master patterns to define the shape of the PCD bit. In many instances, the molds comprise several sections which need to be assembled. Moreover, specialized mold pieces need to be formed and incorporated into the mold for the purpose of forming passages, canals, or cutaways. To achieve desired tolerances, the molds are often machined. Due to difficulties in chucking a mold, machining of a mold to achieve the desired tolerances is a formidable task.

The vast number of manual operations required in forming a mold and subsequently forming a bit from the mold promotes inconsistencies between formed bits. Consequently, the strength varies from bit to bit, making it difficult to ascertain the life expectancy of each bit. As a result, the bits on a drill string are replaced more often so as to prevent an unexpected bit failure during drilling. In addition, these vast number of manual steps result in high bit manufacturing costs.

Accordingly, there is a need for a method for manufacturing a PCD bit that does not require the use of molds and/or master patterns so as to reduce the number of required manual operations. More specifically, there is a need for a method of manufacturing a PCD bit by machining processes. Machining of a bit material in its final hardened state is very difficult, often resulting in the failure of the machining cutters, e.g., the milling bits. Thus, there is a need for a green from which a PCD bit will be machined that is in a state that is soft enough to allow for machining, yet hard enough to allow for handling. Moreover, a means must be provided to allow the material to be chucked on a machine (e.g., a milling machine) for the purpose of machining.

SUMMARY OF THE INVENTION

To form a green state block (also referred to herein as a "green") bonded to a metallic blank, a metallic blank is suspended vertically in a flexible vessel which can be fully enclosed and sealed, such as a rubber boot. A mixture of powder metal and binder (or infiltrant) is then introduced into the flexible vessel surrounding the lower end of the blank, leaving a portion of the blank exposed. The exposed portion of the blank forms the pin of the PCD bit. The vessel is then isostatically (cold or hot) or mechanically pressed causing the mixture to stick onto itself and onto the blank forming a green on the blank. To form a stronger green, the green can be presintered after the pressing process. In an alternate embodiment, wax is also mixed in with the powder metal and binder. The wax aids the sticking of the powder during the pressing process. In an alternate embodiment, the material inside the vessel is presintered to create a green which is bonded to the blank. With this embodiment, pressing is not required and the vessel does not have to be flexible.

Typically the powder metal is a powder of steel or tungsten carbide, while the binder is powder manganese brass, or other copper or nickel base alloy binder. The blank is preferably made of steel.

In alternate embodiments, ductile metal powders that are soluble with the binder are also added to the mixture. The addition of the ductile metal tends to add green strength. In a further embodiment, a organic polymer is used instead of a binder. The polymer acts as an adhesive for sticking the powder metal particles together to form a green. In yet a further embodiment, flux or titanium may be added as an oxygen scavenger, allowing for better wetting of the powder metal.

Once the green is formed on the blank, the exposed portion of the blank is chucked onto a milling machine whereby the blank and green are turned and the green is milled into the shape of a PCD bit head. Once milled, the green and blank are sintered, hardening the green and strongly bonding it to the blank. If wax was mixed in with the powder metal and binder or infiltrant, the wax is burned off during the sintering process. If an organic polymer is used instead of a binder, flux and a binder must be placed on top of the green so that it infiltrates and bonds the metal powders during the sintering process.

The blank serves as the bit pin. The end of the exposed portion of the blank may be threaded to allow for threading of the bit onto a drill string. In an alternate embodiment, a threaded section or pin may be welded onto the end of the exposed portion of the blank to allow for threading onto a drill string.

DETAILED DESCRIPTION

Figure 1:
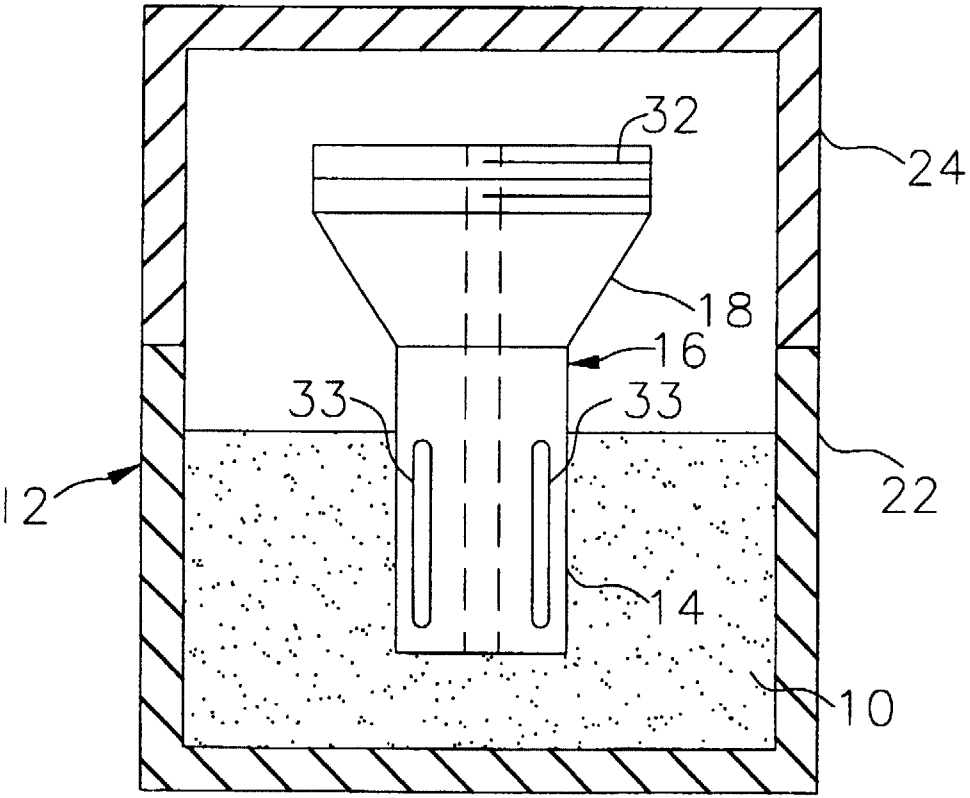
FIG. 1 is a cross-sectional view of a flexible vessel containing a powder mixture and a metallic blank with one end embedded in the mixture.

Referring to FIG. 1, a metallic blank 16 is suspended vertically in a flexible vessel 12 such as a rubber boot which can be fully enclosed and sealed. Preferably, the lower end of the suspended blank does not make contact with the walls of the flexible vessel as shown in FIG. 1. The vessel may comprise two pieces, as shown in FIG. 1, a base 22 sealably enclosed by cover 24. A powder metal is mixed in with a binder (or infiltrant) to get an even powder metal and binder mixture 10 and is introduced into the flexible vessel 12 surrounding the lower end 14 of the suspended blank. Preferably, the powder metal is a powder steel or tungsten carbide while the binder is a manganese brass. Other binders such as copper or nickel base alloy binders may be used as well. In an alternate embodiment, wax is mixed in with the powder metal and binder. In another embodiment, an organic polymer, instead of a binder, is mixed in with the powder metal. In yet a further embodiment, titanium is added to the mixture as an oxygen scavenger. Alternative, flux may be added as an oxygen scavenger. An oxygen scavenger depletes the oxygen for better wetting.

In further embodiments, ductile metal powders which are soluble with the binder used may be mixed in to add green strength. Typical ductile metal powders that can be added include nickel, iron and silver. The ductile metal powders alloy with the binder during sintering. These ductile metal powders tend to wet the tungsten carbide or steel. They also tend to act as binders. In essence, use of the ductile powders dilutes the tungsten carbide or steel eventually resulting in a bit having decreased erosion resistance but increased strength and toughness. Preferably, the ductile metal powders should be limited to a maximum weight equal to approximately 12% of the tungsten carbide or steel weight.

Outside means (not shown) may be used for suspending the blank in the vessel. After the mixture is introduced into the vessel, the blank can be released from the means from which it is suspended, as the mixture should provide sufficient support to hold the blank in a vertical position.

In another embodiment, a portion of the powder metal mixture is introduced into the flexible vessel followed by the vertical placement of the blank into the vessel so that the blank lower end 14 is resting against the mixture 10. The remaining mixture is then introduced into the vessel to surround the lower end of the blank. In yet a further embodiment, the mixture is introduced into the vessel first and then the lower end 14 of the blank is submerged into the mixture.

Figure 2:
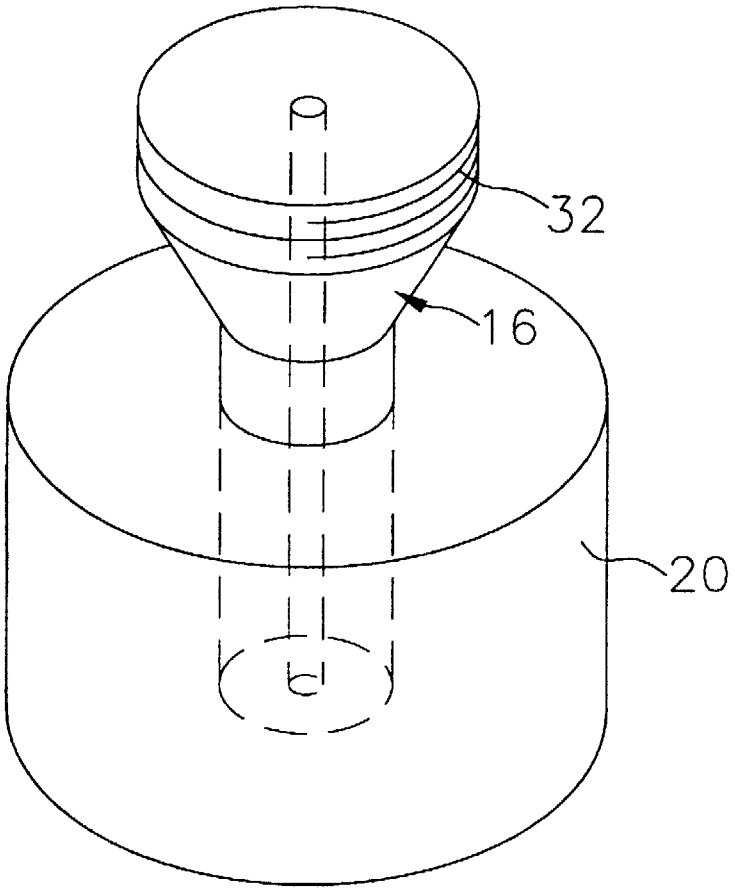
FIG. 2 is an isometric view of a green on a blank.

The upper end 18 of the blank remains exposed within the vessel. This exposed end of the blank may serve as the pin of the PCD bit. In such case the exposed end must be shaped accordingly and must be threaded with threads 32 to allow for threading onto the end of a drill string. In an alternate embodiment, the exposed blank provides structure on to which is welded a threaded pin. The blank depicted in FIGS. 1 and 2 is for illustrative purposes only. It will be apparent to one skilled in the art that other shapes (geometries) of blanks can be used to form pins having different shapes as may be required.

Typically, the metallic blank is made of steel. To aid the bonding of the mixture to the metallic blank, grooves 33 may be formed on the outer surface of the lower metallic blank portion which would be in contact with the powder metal mixture.

The vessel containing the mixture and blank is isostatically (hot or cold) or mechanically pressed, pressing some of the binder or infiltrant into the powder metal causing the mixture to stick to itself and on to the blank forming green state block of material 20 (referred herein as "the green") bonded to the blank, as shown in FIG. 2 (with the vessel removed). In cases were wax is mixed in the mixture, the wax enhances the ability of the mixture to stick together.

In the embodiment where an organic polymer is used instead of a binder, the organic polymer acts as an adhesive, bonding the metal powder particles together during pressing to form a green. Similarly, in the case where a ductile metal powder is mixed in with the mixture, cold flowing of the ductile metal during pressing causes sticking of the mixture thereby forming a green.

In a further embodiment, during or after pressing, the green with the bonded blank are presintered, i.e., they are exposed to a temperature which causes partial sintering of the powder metal and blank by some of the binder, ductile metal powder or organic polymer to form a harder green and a stronger bond between the green and the blank. This temperature is lower than the sintering temperature. Presintering can be achieved by hot isostatic pressing the vessel and mixture. Typically, the heat from hot isostatic process tends to increase the ductility of the binder, ductile metal powder, or organic polymer, resulting in a green with enhanced strength.

In yet a further embodiment, the mixture of material surrounding the blank is only presintered and is not isostatically or mechanically pressed. With this embodiment, the flexibility of the vessel is irrelevant. A container that can hold the mixture and which is capable of withstanding the presintering temperatures is sufficient.

Once the green is formed on the blank, the green and blank are removed from the vessel and the exposed portion of the blank is chucked onto a milling machine. The exposed portion of the blank provides sufficient structure for chucking on a milling machine. The green and blank are then turned and the green is milled. It should be noted that the blank with the green can be chucked on other machines (e.g., a lathe) to allow for various other machining operations. Reference to milling machines and milling operations is made by way of example only.

By being in a green state, the block of material is soft enough to be easily milled, yet is hard enough to allow for handling. A sufficient amount of binder, infiltrant or organic binder must be mixed with the powder metal to ensure an adequate green strength that will allow for handling and milling of green. If the block is too soft or weak, handling of the block without damaging it, is difficult. If the green is too strong or hard, machining may be precluded by frequent breakage of the machining cutters (e.g., inserts).

Figure 3:
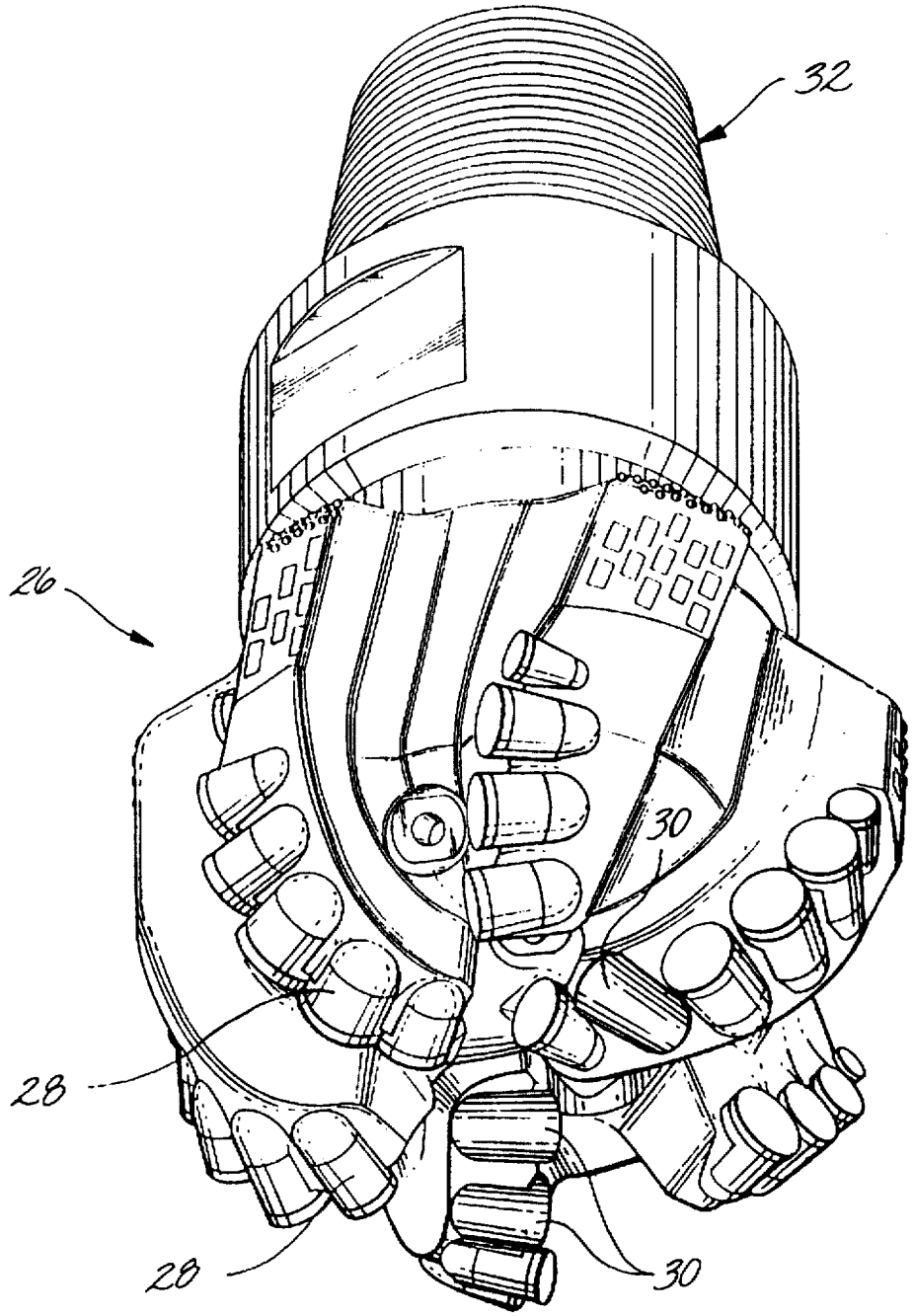
FIG. 3 is an isometric view of a PCD bit with some installed PCD cutters.

Once the green is machined into the shape of a PCD bit head having cavities 30 to accommodate PCD cutters, the green bit head (with the bonded blank) is sintered forming a PCD bit 26 as shown in FIG. 3. Sintering causes the binder to infiltrate and harden the powder metal and strongly bond to the blank, resulting in the formation of a PCD bit wherein the blank is the bit's pin. In cases where wax is mixed in the mixture, the wax is burned off during the sintering process. If an organic binder is used when forming the green, a binder must be placed on top of the green so that it infiltrates and bonds the metal powders during the sintering process. Manganese brass or other copper, nickel or silver based binders may be used. In addition, an oxygen scavenger such as a flux may added to enhance the wetting of the metal powders during the sintering process, increasing the strength of the resulting part. However, an oxygen scavenger may not be necessary if one has already been added in the mixture which formed the green.

Once formed, PCD cutters 28 can be inserted and brazed into the PCD head cavities 30 using conventional methods.

Although this invention has been described and certain specific embodiments, many additional modifications and variations will be apparent to those skilled in the art. It is, therefore, understood that within the scope of the appended claims, this invention may be practiced otherwise then specifically described.

What is claimed is:

1. A method for manufacturing a green state PCD bit comprising the steps of:

suspending a metallic blank having first and second ends into a vessel;

introducing a powder metal and a binder into the vessel forming a mixture, the mixture surrounding a first end of the blank;

setting the mixture to a green state part;

removing the vessel; and forming a PCD bit head from the green state mixture.

2. A method as recited in claim 1 wherein the second end of the blank is shaped as a PCD bit pin.

3. A method as recited in claim 1 further comprising the step of mixing the powder metal and binder prior to the introducing step.

4. A method as recited in claim 1 wherein the introducing step comprises introducing a powder metal selected from the group consisting of steel and tungsten carbide.

5. A method as recited in claim 1 wherein the introducing step comprises introducing a binder consisting of materials selected from the group consisting of manganese brass, copper base alloys, and nickel base alloys.

6. A method as recited in claim 1 wherein the introducing step further comprises the step of introducing a ductile metal into the mixture, the ductile metal selected from the group consisting of nickel, iron, and silver.

7. A method as recited in claim 6 wherein the introducing step comprises the step of introducing a ductile metal whose weight content does not exceed 12% of the weight content of the powder metal.

8. A method as recited in claim 1 wherein the introducing step further comprises the step of introducing wax into the mixture.

9. A method as recited in claim 8 wherein the introducing step further comprises the step of introducing a ductile metal selected from the group consisting essentially of nickel, iron, and silver.

10. A method as recited in claim 8 wherein the forming step comprises the step of heating the green state mixture to burn off the wax.

11. A method as recited in claim 1, wherein the introducing step further comprises the step of mixing an oxygen scavenger with the mixture.

12. A method as recited in claim 11, wherein the introducing step comprises the step of mixing in a flux.

13. A method as recited in claim 11, wherein the introducing step comprises the step of mixing in titanium.

14. A method as recited in claim 1 wherein the suspending step comprises the step of suspending the metallic blank into a flexible vessel.

15. A method as recited in claim 1 wherein the setting step comprises the step of pressing the vessel sticking the mixture together and to the blank forming a green on the blank.

16. A method as recited in claim 15 wherein the setting step comprises the step of mechanically pressing the vessel sticking the mixture together and to the blank.

17. A method as recited in claim 15 wherein the setting step comprises the step of isostatically pressing the vessel sticking the mixture together and to the blank.

18. A method as recited in claim 15 further comprising the step of partially sintering the pressed mixture by exposure to heat, creating a harder green on the blank.

19. A method as recited in claim 1 wherein the setting step comprises the step of partially sintering the mixture to a green state and binding it to the blank.

20. A method as recited in claim 1 wherein the suspending step comprises the step of suspending a metallic blank having a groove on an outer surface of its first end to provide a surface for improved bonding with the mixture.

21. A method as recited in claim 1 wherein the suspending step comprises the step of suspending a steel blank.

22. A method as recited in claim 1 wherein the suspending step comprises the step of suspending a metallic blank having a threaded second end for threading the bit to the end of a drill string.

23. A method as recited in claim 1 further comprising the step of welding a threaded section at the end of the blank for threading to the end of a drill string.

24. A method as recited in claim 1 wherein the forming step comprises machining the green state part.

25. A method as recited in claim 24 wherein the machining step comprises the step of chucking the second end of the metallic blank into a machine and machining the green state part to form a PCD bit head.

26. A method as recited in claim 25 wherein the machining step comprises the step of chucking the second end of the metallic blank to a milling machine.

27. A method as recited in claim 1 wherein the forming step comprises the step of sintering the green state part.

28. A method for manufacturing a PCD bit comprising the steps of:

introducing a mixture of powder metal and binder into a flexible vessel;

placing a first end of a metallic blank on the mixture within the flexible vessel;

surrounding the first end of the blank with the mixture;

pressing the flexible vessel containing the mixture so as to stick the mixture onto the metallic blank forming a green on the blank;

removing the vessel exposing the green and blank;

machining the green into a PCD bit head; and sintering the green bit head, infiltrating the bit and the blank outer surface with the binder, setting the bit head hard and creating a strong bond with the blank forming a PCD bit wherein the blank is the bit pin.

29. A method as recited in claim 28 wherein the surrounding step comprises the step of introducing additional mixture of powder metal and binder to surround the first end of the blank.

30. A method as recited in claim 28 wherein the introducing step further comprises the step of introducing a ductile metal in the mixture, the metal selected from the group consisting of nickel, iron and silver.

31. A method as recited in claim 28 wherein the introducing step further comprises the step of introducing a metal scavenger in the mixture.

32. A method as recited in claim 28 wherein the placing step comprises placing a first end of a metallic blank having a groove on its outer surface.

33. A method as recited in claim 28 wherein the introducing step comprises introducing the mixture into a vessel made from a plastically deformable material.

34. A method as recited in claim 28 wherein the step of pressing the flexible vessel comprises the step of isostatically pressing the vessel.

35. A method as recited in claim 28 wherein the step of pressing the flexible vessel comprises the step of mechanically pressing the vessel.

36. A method as recited in claim 28 further comprising the step of partially sintering the mixture prior to the machining step.

37. A method as recited in claim 28 wherein the step of machining the green further comprises the step of chucking the blank on a machine to be used for machining.

38. A method as recited in claim 37 wherein the step of machining comprises the step of chucking the blank on a milling machine.

39. A method as recited in claim 28 further comprising the step of inserting PCD cutters on the PCD bit head.

* * * * *